US005120911A

United States Patent [19]

Gazzola

[11] Patent Number: 5,120,911

[45] Date of Patent: Jun. 9, 1992

[54] SELF-PROPELLED CABLE-WAY UNIT RIDING UPON A SURFACE CONDUCTION CABLE

[75] Inventor: Giovanni A. Gazzola, Rome, Italy

[73] Assignee: Cable Link S.r.l., Rome, Italy

[21] Appl. No.: 662,573

[22] Filed: Mar. 1, 1991

Related U.S. Application Data

[63] Continuation-in-part of Ser. No. 407,641, Sep. 15, 1989, abandoned.

[30] Foreign Application Priority Data

Sep. 16, 1988 [IT] Italy ..... 48359 A/88

[51] Int. Cl.[5] ..... B60L 5/38; B61B 7/06

[52] U.S. Cl. ..... 191/45 A; 104/167; 104/112; 104/117.1; 191/53; 191/33 PM

[58] Field of Search ..... 191/33 PM, 12 R, 45 A, 191/53, 58, 33 R; 104/112, 306, 167, 115, 117.1, 288, 118; 105/49; 174/113 R, 114 S, 128

[56] References Cited

U.S. PATENT DOCUMENTS

| | | | |
|---|---|---|---|
| 952,539 | 3/1910 | Lugo Vina | 104/167 |
| 976,859 | 11/1910 | Eisele | 191/53 |
| 1,201,206 | 10/1916 | Lewis | 104/117.1 |
| 1,246,139 | 11/1917 | Montine | 104/117.1 |
| 2,232,222 | 2/1941 | Flinn | 104/112 X |
| 4,185,562 | 1/1980 | Hatori et al. | 104/112 |
| 4,882,998 | 11/1989 | Lipp | 104/112 |

*Primary Examiner*—Robert J. Spar
*Assistant Examiner*—Brian K. Dinicola
*Attorney, Agent, or Firm*—Wenderoth, Lind & Ponack

[57] ABSTRACT

A self-propelled member or carriage runs along a stationary surface-conducting cable formed of alternately disposed conducting and insulating turns. The carriage is provided with a rotor extending around the cable and having contacts in a conductive relation with the conducting turns of the cable. At least two pulleys are rotatably mounted to the carriage with the cable interposed between the pulleys. An electric motor is operatively electrically connected to the contacts of the rotors and is drivingly connected to the pulleys. Electric power is transmitted from the cable by the rotor to the motor whereupon the motor drives the pulleys to propel the carriage along the cable.

14 Claims, 4 Drawing Sheets

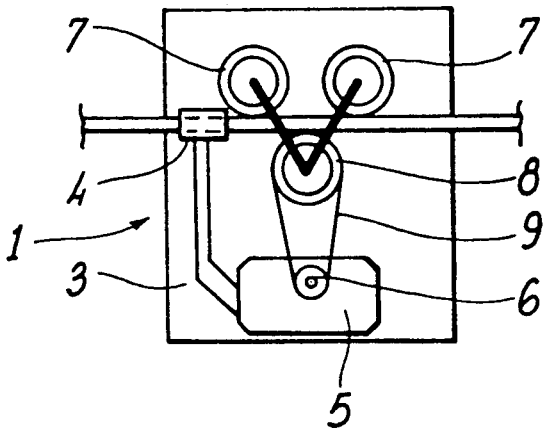
FIG. 1
FIG. 2
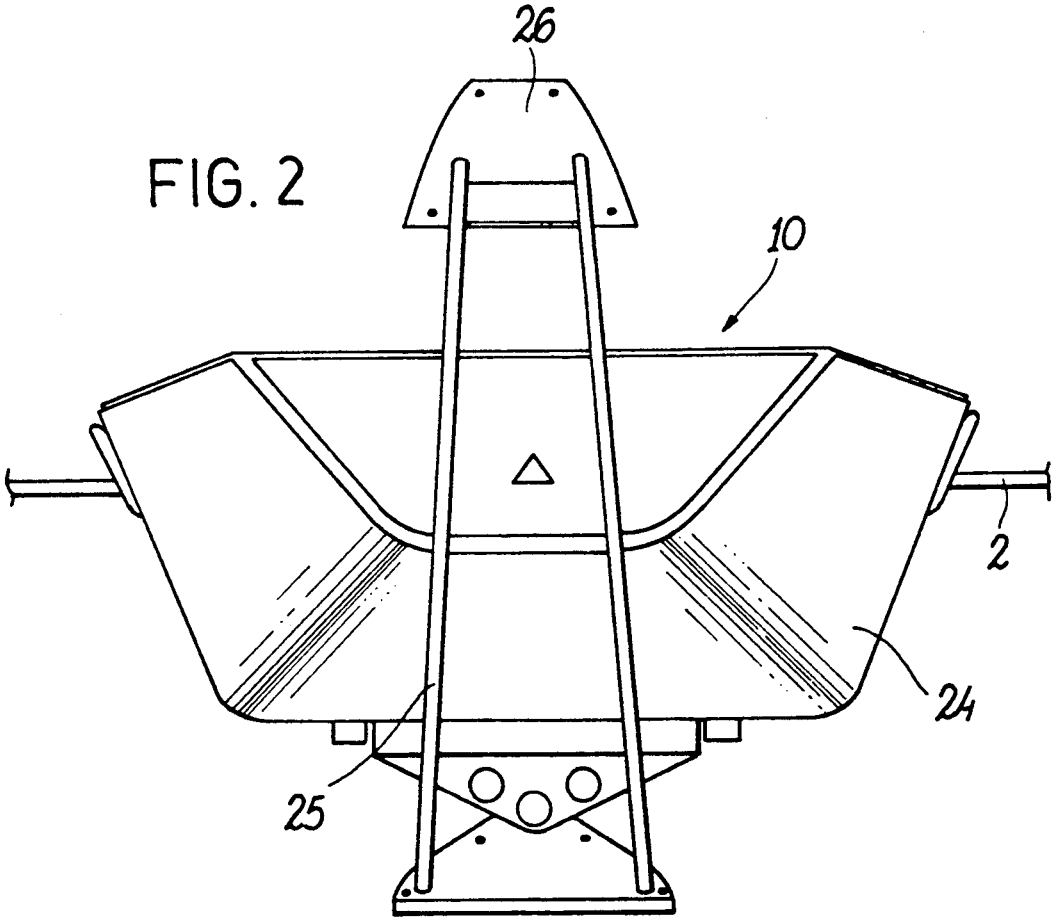

SELF-PROPELLED CABLE-WAY UNIT RIDING UPON A SURFACE CONDUCTION CABLE application is a Continuation-In-Part of U.S. Ser. No. 07/407,641 filed Sept. 15, 1989 and now abandoned.

BACKGROUND OF THE INVENTION

The present invention relates to a self-propelled cable-way unit running on a surface-conduction cable, and more particularly to a transportation unit running on a cable, which unit does not require for its own motion any motion of the cables themselves.

It is well known that both large-size and small-size cable-ways employ either a moving cable on which the load is suspended, said cable being called "the pulling cable" and a stationary cable which is called "the supporting cable", or a single "pulling and supporting" cable that is kept moving.

These types of cable-ways are subject to a number of problems, owing to the fact that they require a fixed installation for the cable(s), and a large number of mechanical contrivances consisting of guides and transmission means provided by pulleys, and owing to the fact that the cables must be well engineered to provide a proper pulling force.

U.S. Pat. No. 471,790 (M.W. Hassan) discloses an overhead cable-way device which utilizes a spirally threaded wire (B) acting both as a support for a car (D) travelling thereon as well as a means to conduct current to the car's driving motor.

Moreover, Lugo-Vina (U.S. Pat. No. 952,539) teaches a self-powered travelling carrier adapted for movement along a helically wound overhead wire.

Other similar devices are described in U.S. Pat. No. 4,882,998 (Lipp) and U.S. Pat. No. 2,323,222 (Flinn).

SUMMARY OF THE INVENTION

An object of the cable-way unit according to the present invention is to obviate the drawbacks of the prior art. To achieve this object the present invention provides a single stationary cable which conducts electric current along its surface, and which performs the double function of supporting the load and of supplying electric power, or any other type of signals, to the self-propelled carriage suspended on the cable, as well as to any of various kinds of equipment connected to said carriage.

The cable-way unit according to the present invention is particularly well-suited to small cable-way systems or even portable cable-way systems employed in a number of different fields.

More particularly, the cable-way unit according to the present invention can be employed for automatically aiming television cameras or projectors, for performances and shows, for surveillance purposes, or for scientific research (archeology, speleology). If a plant of the type disclosed herein is used, overhead shots can be taken by providing the cable over a stadium, for instance, and fastening a television camera to said self-propelled carriage, and exploiting known electronically coded automatic control units to aim the camera.

Moreover, the present invention can also be employed for transferring materials or men over an obstacle, for rescues in case of fire, or in the mountains for passing over precipices, or over streams and so on. For instance, a unit of the type mentioned herein could be borne by a truck; a killick could be fastened to an end of the cable so that it could be thrown towards an inaccessible point or beyond an obstacle. Once the killick is fastened to the desired point, the self-propelled carriage can start moving along the cable.

Moreover, the present invention can also be adapted for use in the naval field, for transferring men or materials from one naval unit to another, or from a ship to land, and in the aeronautical field, for transferring materials or men from one helicopter to another, or even from one aircraft to another, so as to place the holds or the two aircraft in communication. As far as the means for passing the cable from one aircraft to another is concerned, the present system for refueling in flight can be employed.

The cable-way unit according to the present invention can be applied to space technology for transferring objects from one point to another on a space platform, or from a shuttle to a platform, or for guiding astronauts outside the shuttle.

These and other uses are facilitated according to the present invention through the provision of a cable-way unit which substantially comprises a multipolar cable that ensures an insulation of its individual conducting cables and a self-propelled carriage that is capable of shifting along said cable, such carriage being provided with all equipment suitable to perform the specific tasks for which it is intended.

Specifically, the cable-way unit of the present invention comprises a surface-conduction cable having conducting turns alternated with non-conducting turns, as well as a self-propelled member or carriage running on said cable and including a rotor member arranged around said cable and rotatably slidable over the same, provided with contacts for drawing electric current from the cable itself, at least two pulleys, between which said cable is disposed, for causing said self-propelled member or carriage to move along the cable, an electric motor that receives electric power drawn by said contacts and is mechanically connected to said pulleys, and means for providing a coupling for ancillary devices.

According to a preferred embodiment of the cable-way unit, two pulleys are juxtaposed in a horizontal plane passing through the axis of said cable, one of said pulleys being provided on a rotational axis connected to said electric motor, and mechanical means, preferably two gear wheels meshing with one another and coaxial with said pulleys, are provided to transmit the rotational output of the electric motor to at least one of the pulleys. More specifically, according to the present invention, three treaded pulleys can be mechanically connected in such positions as to exert contact pressure on the cable, such pulleys being provided above and below the cable, and at least one of said pulleys being mechanically connected to the output shaft of said electric motor.

Further, the distance between the axes of said pulleys can be adjustable, and the groove defined between said pulleys can conform to the shape of said cable.

Preferably the insulating turns of said cable are in relief or project radially outward with respect to the conducting turns.

Said conducting turns can be alternated with turns of other conducting wires in order to transmit different types of signals along said surface-conducting cable.

Said surface-conducting cable can be provided with an insulating member arranged inside the turns which in addition provides the cable with a higher mechanical strength. The inner insulating material can in turn be hollow in order to house more cables such as telephonic cables.

The rotor can have an inner surface so shaped as to slidingly engage said cable.

The contacts for drawing electric power from the cable can be sliding contacts such as brushes, preferably radially disposed around the rotor, said contacts being borne by the rotor member itself.

Still further, according to the invention, a gyroscope as an ancillary device can be coupled to the cable-way unit to stabilize the cable-way unit.

BRIEF DESCRIPTION OF THE DRAWINGS

The invention will be better understood from the following description of some of the preferred embodiments of the same, with particular reference to the accompanying drawings wherein:

FIG. 1 is a schematic, cut-away side view of a cable-way unit according to the present invention;

FIG. 2 is a perspective view of a second embodiment of the cable-way unit according to the invention;

DETAILED DESCRIPTION OF THE PREFERRED EMBODIMENTS

Figure 3:
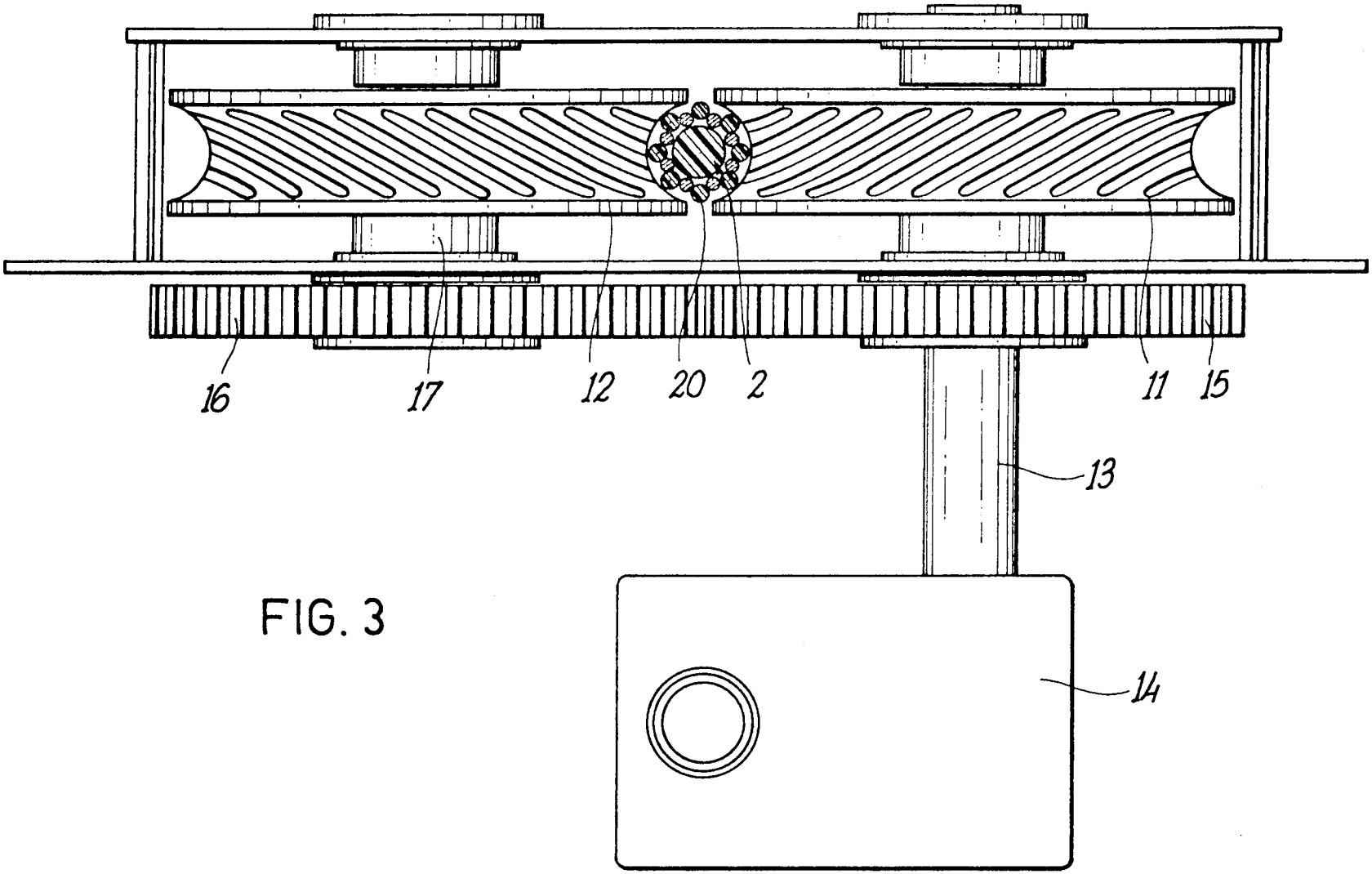
FIG. 3 is a schematic, cut-away front view of the cable-way unit of FIG. 2.

Referring first to FIG. 1, a cable-way unit 1 is shown running on a surface-conducting cable 2. Said cable-way unit comprises a self-propelled carriage 3 bearing a rotor member 4. The rotor member 4 is electrically connected to a motor 5 that is in turn provided with a toothed pulley 6.

The carriage 3 is provided with two treaded pulleys 7, that rest on the top portion of the cable 2, and with a pulley 8 pressing the cable 2, which pulley is caused to move by the motor 5 through a belt 9.

The pulleys 7 and the pulley 8 are disposed in the vertical plane passing through the axis of the cable 2. The surface-conducting cable 2 consists of insulating turns alternated with conducting turns. The insulating turns are provided in relief or are raised with respect to the conducting turns so that the latter are protected against short-circuits if the cable 2 happens to wrap around itself during service or if it happens to contact external conducting surfaces. The number of conducting turns will vary depending upon the specific requirements of the particular application so that signals of whatever type that are required can be transmitted for the particular application.

The insulating turns and the conducting turns are wrapped around an insulating core which can also serve the purpose of strengthening said cable 2 and which can also be exploited for accommodating more cables such as a telephone cable, therein and which cables can be employed for services which are not specific to the operation of the unit itself (motion and orientation of the carriage 3 as well as of the structures connected to the same).

The rotor 4 draws electric power from the conducting turns through sliding contacts which are connected to the electric motor 5 so that when the cable is energized, the rotor member 4 supplies power to the motor 5 and various other devices to operate said cable-way unit.

Referring to FIGS. 2-14 5, a second embodiment of the cable-way unit according to the present invention will now be described. The cable-way unit 10 is driven along the cable 2 by two pulleys 11, 12 disposed in the horizontal plane passing through the axis of the cable 2.

The rotation shaft 13 of the pulley 11 is connected to a motor 14. On the same shaft 13, a first gear wheel 15 is provided which engages a second gear wheel 16 provided on the rotation shaft 17 of the pulley 12.

In this way, the output of the motor 14 is transmitted to both of the pulleys 11 and 12.

The distance between the shafts 13 and 17 can be adjusted by means not shown, so that the pulleys 11 and 12 can be adapted for use with different sized cables.

Figure 4:
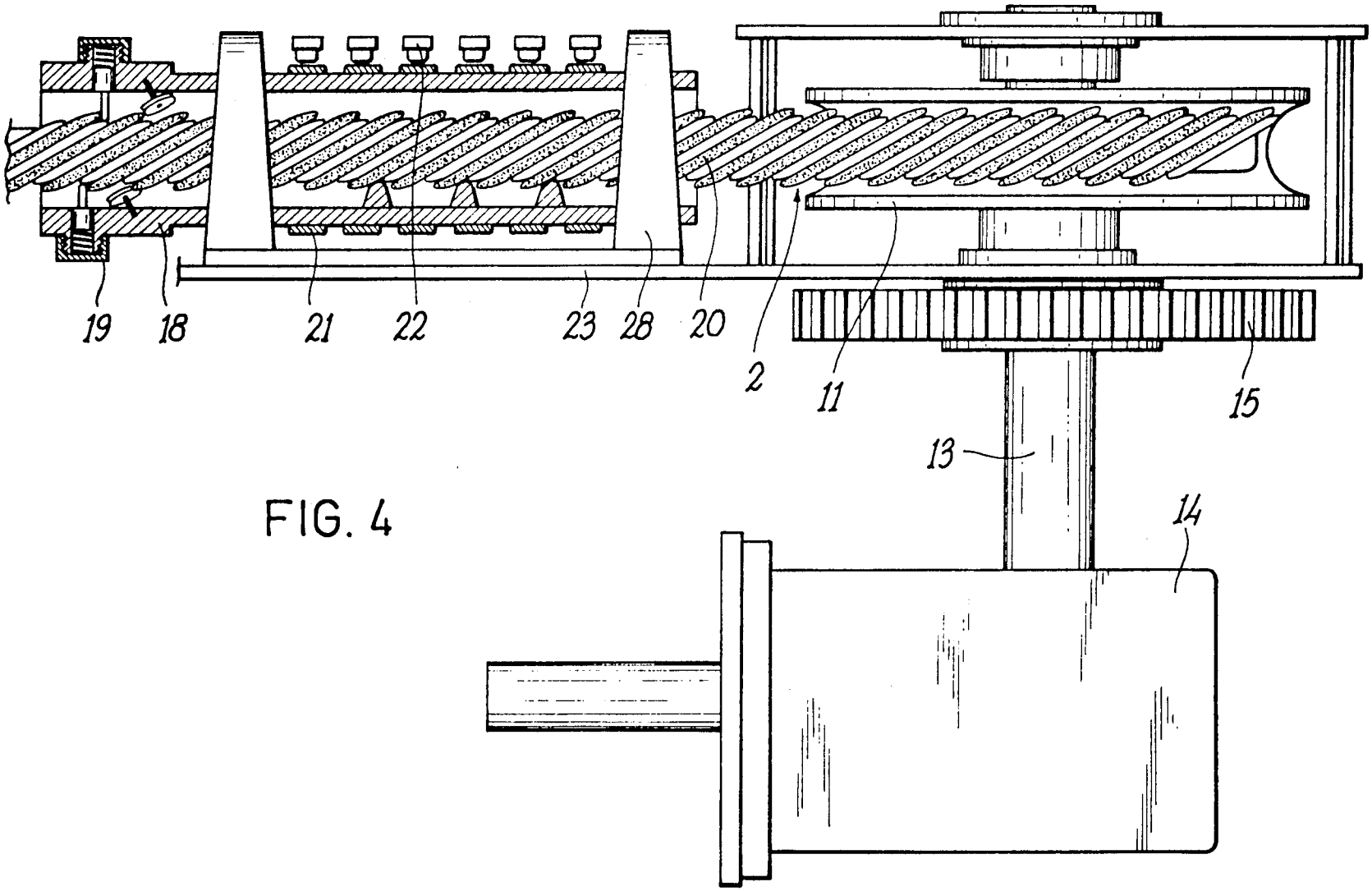
FIG. 4 is a schematic, cut-away side view of the cable-way unit of FIG. 2.

Referring now particularly to FIG. 4, a rotor 18 is provided on the cable 2, beyond the pulley 11.

Said rotor 18 has four wheels 27 that rotatably engage the corresponding turns of the cable 2.

In the front part of the rotor 18, a number of radially disposed brushes 19, corresponding to the number of conductive turns, slide on the conductive turns 20 of the cable 2.

Said brushes 19 are electrically connected to corresponding rings 21, disposed on the outer surface of the rotor 18.

Corresponding brushes 22 slide on the rings 21, transferring the electric signals to the various devices.

For example, two of the brushes 22 are connected to the motor 14 for power supply purposes.

Figure 5:
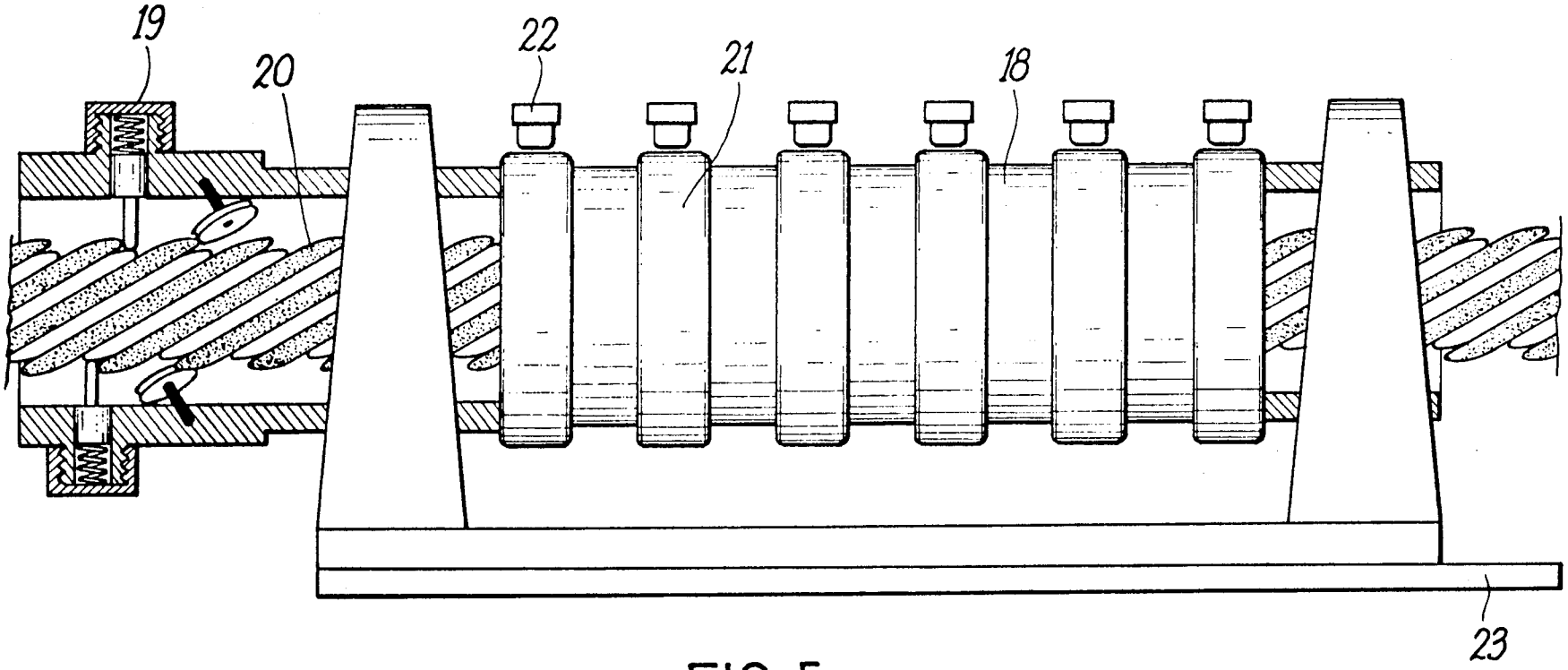
FIG. 5 is an enlarged view of a particular detail of FIG. 4.

In FIGS. 4 and 5, six brushes 22 are shown, but it is obvious that the number of brushes can be different, depending upon particular requirements.

The rotor 18 is connected to the assembly of the pulleys 11 and 12 by a bracket 23 and supports 28 and can freely rotate with respect to the supports 28.

A bracket 25 is provided on the carriage 24 of the cable-way 10 to support or otherwise couple the object to be transported, for example a camera (not shown), and a gyroscope 26 useful to balance the cable-way unit 10. With the fundamental technical characteristics of the cable-way unit disclosed above, said unit according to the present invention can be adapted to a number of different applications.

For instance, for space applications, the cable-way unit can take the form of a small self-propelled unit provided with a handle.

As already disclosed above, said cable 2 can be provided with turns of different cables that carry different types of signals which are required for the full operation of the entire structure.

In the case of a single pair of turns transmitting an electric signal to the rotor member (4, 18) and then to the motor for forwarding the carriage (3, 24), a device can be provided which is capable of reading coded signals transmitted along the cable 2, and which device could also be capable of controlling the orientation and aiming of a television camera or capable of performing other functions.

Although the present invention has been disclosed with specific reference to some preferred embodiments of the same, it is to be understood that modifications and/or changes can be introduced to the same by those skilled in the art without departing from the spirit and scope of the invention as defined in the appended claims.

What is claimed is:

1. A cable-way system comprising: an electrically conducting cable having alternately disposed electrically conductive and non-conductive turns at the outer surface thereof; and a self-propelled member moveable along said cable, said self-propelled member including a rotor extending around said cable and rotatably slidable over the same, the rotor having contacts in an electrically conductive relation with said electrically conductive turns for drawing electric power from said cable, at least two pulleys, between which said cable is disposed, rotatably supported on said self-propelled member, an electric motor operatively electrically connected to said rotor so as to receive electric power drawn by said contacts, and said motor being mechanically connected to at least one of said pulleys for rotating the same to cause said self-propelled member to move along said cable, and means for coupling auxiliary devices to the self-propelled member.

2. A cable-way system according to claim 1, wherein said pulleys are juxtaposed in a horizontal plane passing through a longitudinal axis of said cable, one of said pulleys having a rotational shaft connected to said electric motor, and further comprising mechanical means for transmitting the rotary motion from said one of said pulleys connected to the electric motor to the other of said pulleys.

3. A cable-way system according to claim 2, wherein said mechanical means comprises two gears engaged with one another and coaxial with said pulleys, respectively.

4. A cable-way system according to claim 1, wherein said at least two pulleys comprise three pulleys disposed in a vertical plane passing through a longitudinal axis of said cable, and further comprising means for mechanically connecting the pulleys in a manner in which the mutual positions thereof are fixed, said pulleys being located above and below said cable, respective, and at least one of said pulleys being mechanically connected to the electric motor.

5. A cable-way system according to claim 1, wherein said pulleys have treads.

6. A cable-way system according to claim 1, and further comprising regulation means for adjusting the linear distance between the rotational axes of said pulleys.

7. A cable-way system according to claim 1, wherein said pulleys each have a peripheral surface defining a groove, the grooves forming a space at a location where said peripheral surfaces face each another, and said space having a cross sectional shape corresponding to that of said cable, such that said peripheral surfaces are in rolling contact with said cable and conform to said outer surface of said cable.

8. A cable-way system according to claim 1, wherein said non-conducting turns are raised or in relief with respect to the conducting turns.

9. A cable-way system according to claim 1, wherein said cable also has parallel electrically conductive wires alternately disposed with respect to said electrically conductive turns.

10. A cable-way system according to claim 1, wherein said cable has an inside insulating member a longitudinal axis of the cable.

11. A cable-way system according to claim 1, wherein said rotor has an inner portion in sliding engagement with said cable.

12. A cable-way system according to claim 1, wherein said contacts for drawing electric power form the cable are brush sliding contacts.

13. A cable-way system according to claim 12, wherein said brush contacts are radially disposed around the rotor, and said rotor further has outer rings to which the brush contacts are connected, and second brushes slidingly coupled to said outer rings.

14. A cable-way system according to claim 1, and further comprising a gyroscope coupled to said self-propelled member via said means for coupling auxiliary devices.

* * * * *